United States Patent [19]

Akyol

[11] Patent Number: 4,510,183

[45] Date of Patent: Apr. 9, 1985

[54] METHOD FOR APPLYING WEAR-RESISTANT COATINGS ON WORKING SURFACES OF TOOLS AND DEVICES

[75] Inventor: Atilla Akyol, Bad Essen-Linne, Fed. Rep. of Germany

[73] Assignee: Rabewerk Heinrich Clausing, Bad Essen, Fed. Rep. of Germany

[21] Appl. No.: 532,242

[22] Filed: Sep. 14, 1983

[30] Foreign Application Priority Data

Sep. 16, 1982 [DE] Fed. Rep. of Germany ..... 3234310

[51] Int. Cl.[3] ..... B05D 1/22

[52] U.S. Cl. ..... 427/185; 427/27; 427/47; 427/205; 427/431; 427/436; 427/438

[58] Field of Search ..... 427/27, 47, 185, 205, 427/431, 432, 436, 438

[56] References Cited

U.S. PATENT DOCUMENTS

| | | | |
|---|---|---|---|
| 2,611,710 | 9/1952 | Woock | 106/1 |
| 3,140,195 | 7/1964 | Nagel | 427/185 |
| 3,391,455 | 7/1968 | Hirohata et al. | 427/205 |
| 3,669,850 | 6/1972 | Draca | 427/205 X |

*Primary Examiner*—Shrive P. Beck

*Attorney, Agent, or Firm*—Flynn, Thiel, Boutell & Tanis

[57] ABSTRACT

A method for applying a wear-resistant coating to a working surface of an object, which working surface is to be exposed to wear. To coat the object, it is dipped in a bath of molten metal containing unmolten hard metal carbide particles dispersed therein, whereby a coating is formed on the object.

12 Claims, No Drawings

METHOD FOR APPLYING WEAR-RESISTANT COATINGS ON WORKING SURFACES OF TOOLS AND DEVICES

FIELD OF THE INVENTION

The invention relates to a method for applying wear-resistant coatings on working surfaces of tools and devices, in particular, earth-working tools, which working surfaces are exposed to wear.

BACKGROUND OF THE INVENTION

It is known to apply wear-resistant coatings on areas of tools which are exposed to high wear. The application of said wear-resistant coatings is effected, for example, by welding using hard-metal electrodes, through the application of the coating material with the help of plasma welding and by spraying (flame spraying) flowable metal powder. These conventional methods for applying wear-resistant coatings are, however, all expensive and complicated. When such coatings are applied by welding with the help of hard-metal electrodes, the coatings are brittle, tearsensitive and breakage-sensitive. When hard-metal layers are applied with the help of flame spraying of flowable metal powder, a great material loss occurs. This is also true for the plasma welding.

In particular, these methods are not economical if large working surfaces are supposed to be provided with wear-resistant coatings, as is the case, for example, with plowshares and other earth-working tools. Moreover, especially in the case of plowshares, it is necessary that the treated surface be as smooth as possible so that a small frictional resistance to the earth exists. In the conventional method, as a rule, an after-treatment is required to obtain a smooth surface and this, since hard layers are involved, is work-intensive and time consuming.

SUMMARY OF THE INVENTION

The basic purpose of the invention is to provide a method for applying wear-resistant coatings on tools and devices, which is also suitable for applying smooth layers to large surfaces which can be carried out in a short time and relatively low expense output, and which does not require any after-treatment for achieving smooth surfaces.

DETAILED DESCRIPTION

According to the method according to the invention, the surfaces of the tools, which are to be coated, are dipped into a bath of molten metal which bath also contains dispersed therein a relatively large amount of hard metal carbide particles. The hard metal carbide particles do not substantially melt or dissolve in the molten metal. When the tool is dipped in the bath of molten metal containing the hard metal carbide particles dispersed therein, a coating of the molten metal containing hard metal carbide particles is formed on the surface of the tool. When the coating cools, it solidifies and the hard metal carbide particles therein adhere to the tool with the coating. The thickness of thecoating formed in one dipping operation can amount to up to 3 mm, but the thickness of the koating depends on the molten metal used and the temperature of the molten bath. The coating which is deposited on the working surface of the tool has a smooth surface and moreover is wear resistant. In particular, in the case of plowshares, the wear-resistance can be three times the wear resistance of an uncoated plowshare.

As the metal to which the hard metal carbide particles are added, it is effective to use, in particular, an iron-based or nickel-based alloy. To the base metal there can be added suitable alloying constituents, for example, boron and silicon in amounts of up to 9 wt.%, so that the melting temperature of the alloy is reduced. Thus, it is easy to obtain, for use as the molten metal, a nickel-based alloy having a liquidus temperature of the melt of 1100° C. and in the case of an iron-based alloy a liquidus temperature of 1250° C.

The hard metal carbide particles can consist of tungsten carbide, chromium carbide, mixtures thereof with each other and/or with molybdenum carbide, titanium carbide and tantalum carbide. The hard metal carbide particles are added to the molten bath of the nickel-based or iron-based metal. The amount of the hard metal carbide particles added to the molten bath depends on the desired wear resistance of the coating and can advantageously amount to from about 10% up to 45% of the weight of the molten metal. The hard metal carbide particles preferably have a particle size in the range of from 50 to 1000 μm.

In one specific example, the molten metal has the following composition in % by weight:

| | |
|---|---|
| Ni | 70–80% |
| Cr | 10–20% |
| B | 4–4.5% |
| Si | 4–4.5% |

and the balance is impurities and/or minor amounts of other alloying constituents. The bath can contain dispersed therein from 5 to 15 wt.% of tungsten carbide particles and from 10 to 20 wt.% of chromium carbide particles, both percentages being based on the weight of the molten metal.

In another specific example, the molten metal has the following composition in % by weight:

| | |
|---|---|
| Fe | 90% |
| B | 4–4.5% |
| Si | 4–4.5% |

and the balance is impurities and/or minor amounts of other alloying constituents. The bath can contain dispersed therein from 10 to 15 wt.% of the tungsten carbide, from 10 to 20 wt.% of chromium carbide and from 7 to 8 wt.% of a mixture of molybdenum carbide, titanium carbide and tantalum carbides.

Should the thickness of the coating layer after the first dipping operation not be sufficiently strong, then after cooling of the first applied layer, the dipping operation can be repeated one more time or any desired number of times. The applied coatings not only possess the advantage that they are smooth and thus do not need any after-treatment, but also they possess the advantage that they are still machinable so that the tools can subsequently still be formed.

The molten bath temperature will be at least about 100° C. higher that the liquidus temperature of the molten metal. It has been found to be advantageous to warm up the tools prior to the dipping operation because then a better bond is obtained between the surface of the tool and the coating. Furthermore, a requirement for obtaining a good bond is that the tools are free of scale and rust. This can be done in a simple manner by a pre-treatment of the tools by means of sandblasting.

An iron-based molten metal shows on the one hand the advantage, that is is less expensive and forms a better bond with the metal of the tool, which is normally steel. However, the iron-based molten metal at the same time shows the disadvantage that it has the tendency to tear formation. A nickel-based molten metal has the advantage that a lower molten bath temperature can be used and shows, in comparison with an iron-based melt, a higher wear resistancy. Of course a nickel-based melt is more expensive.

In addition to dispersing the hard metal carbide particles in the molten metal prior to hot dipping the tool in the melt, the tool can prior to this be provided in the same manner with a hard metal layer, which can be done, for example, by dipping the tool into a hard metal powder or, alternatively, by applying the hard metal carbide particles by means of a magnetic and/or electrostatic method. It is also possible to use the fluidized bed coating method to apply the hard metal carbide particles on the tool surfaces, whereby a suitable conventional binding means, such as borax or the composition disclosed in U.S. Pat. No. 2,611,710, can be applied on the tool surfaces. The tools are subsequently dipped into the molten metal.

Although a particular preferred embodiment of the invention has been disclosed in detail for illustrative purposes, it wil be recognized that variations or modifications of the disclosed apparatus, including the rearrangement of parts, lie within the scope of the present invention.

I claim:

1. A method for applying a wear-resistant coating to a working surface of an object which is to be exposed to wear, comprising the step of dipping said object in a bath of molten metal having unmolten hard metal carbide particles dispersed therein, whereby a coating of said molten metal and said hard metal carbide particles is formed on said working surface of said object.

2. A method according to claim 1, wherein said molten metal is one of an iron-based alloy and a nickel-based alloy.

3. A method according to claim 2, wherein said bath has one of boron and silicon added thereto for reducing the melting point thereof.

4. A method according to claim 1, wherein said molten metal has the following composition in % by weight:

| | |
|---|---|
| Ni | 70–80% |
| Cr | 10–20% |
| B | 4–4.5% |
| Si | 4–4.5% |

the balance of said molten metal being impurities.

5. A method according to claim 4, wherein said bath contains 5–5 wt.% tungsten carbide particles and 10–20 wt.% chromium carbide particles, based on the weight of said molten metal.

6. A method according to claim 1, wherein said molten metal has the following composition in % by weight:

| | |
|---|---|
| Fe | 90% |
| B | 4–4.5% |
| Si | 4–4.5% |

the balance of said molten metal being impurities.

7. A method according to claim 6, wherein said bath contains:

| |
|---|
| 10–15 wt. % tungsten carbide particles<br>10–20 wt. % chromium carbide particles and a<br>7–8 wt. % mixture of molybdenum carbide<br>particles, titanium carbide particles and<br>tantalum [mixed carbides] carbide particles, |

based on the weight of said molten metal.

8. A method according to claim 1, including the step of sandblasting said surface of said object prior to said dipping step.

9. A method according to claim 1, including the step of applying hard metal carbide particles to said surface to be treated prior to said dipping step.

10. A method according to claim 9, wherein said hard metal carbide particles which are applied to said surface prior to said dipping step are in one of a granular powdery and pulpy form.

11. A method according to claim 9, including the step of dipping said object to be treated into a powder prior to said applying step.

12. A method according to claim 11, wherein said hard metal carbide particles which are applied to said surface prior to said dipping step are applied by fluidized bed coating means.

* * * * *

UNITED STATES PATENT AND TRADEMARK OFFICE

CERTIFICATE OF CORRECTION

PATENT NO. : 4 510 183

DATED : April 9, 1985

INVENTOR(S) : Atilla AKYOL

It is certified that error appears in the above-identified patent and that said Letters Patent is hereby corrected as shown below:

Column 4, line 9; change "5-5" to ---5-15---.

Column 4, line 29; delete "[mixed carbides]".

Signed and Sealed this

*Twenty-ninth* Day of *October 1985*

[SEAL]

*Attest:*

DONALD J. QUIGG

*Attesting Officer*

*Commissioner of Patents and Trademarks—Designate*